United States Patent [19]

Noble

[11] 4,260,009

[45] Apr. 7, 1981

[54] APPARATUS FOR CENTRIFUGAL CASTING

[76] Inventor: Charles H. Noble, P.O. Box 58094, Birmingham, Ala. 35209

[21] Appl. No.: 89,306

[22] Filed: Oct. 30, 1979

Related U.S. Application Data

[60] Continuation of Ser. No. 887,213, Mar. 16, 1978, abandoned, which is a division of Ser. No. 778,705, Mar. 17, 1977, Pat. No. 4,124,056.

[51] Int. Cl.[3] ..... B22D 13/02; B22D 13/10; B22D 29/04; B22C 13/10

[52] U.S. Cl. ..... 164/270; 164/5; 164/33; 164/161; 164/178; 164/295; 164/298; 164/344

[58] Field of Search ..... 164/17, 5, 33, 161–163, 164/176–178, 269, 270, 295, 298, 344, 299, 300, 301; 425/262

[56] References Cited

U.S. PATENT DOCUMENTS

| | | | |
|---|---|---|---|
| 1,581,635 | 4/1926 | Henry et al. | 164/33 |
| 2,563,844 | 8/1951 | Johnston | 164/269 |
| 2,657,440 | 11/1953 | Myers | 164/295 |
| 2,870,496 | 1/1959 | Cooper et al. | 164/295 X |
| 3,110,067 | 11/1963 | Abbott | 164/178 |

FOREIGN PATENT DOCUMENTS

| | | | |
|---|---|---|---|
| 694383 | 9/1964 | Canada | 164/295 |
| 2320973 | 11/1974 | Fed. Rep. of Germany | 164/5 |
| 3325 | 1/1976 | Japan . | |

OTHER PUBLICATIONS

Iudin, S. B., et al., *Centrifugal Casting,* 2nd edition, Mashinostroenie, Moscow, 1972, pp. 135–139.

*Primary Examiner*—R. L. Spruill
*Assistant Examiner*—Gus T. Hampilos
*Attorney, Agent, or Firm*—Roylance, Abrams, Berdo and Farley

[57] ABSTRACT

Centrifugal casting apparatus for casting cylinder liners and other tubular articles, characterized by recovery of at least a major portion of the particulate refractory material used to line the mold, with the recovered refractory material being suitable for re-use. The apparatus provides a chamber having aligned openings through which the cast article moves as the article is withdrawn from the mold by a puller. Particulate refractory material from within the mold and from the surface of the cast article is collected in the chamber and conveyed from the chamber to separator means for removal of debris.

9 Claims, 13 Drawing Figures

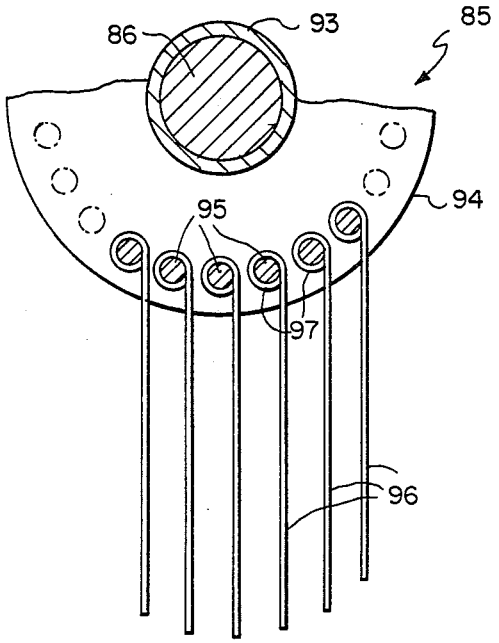
FIG. 7
FIG. 9
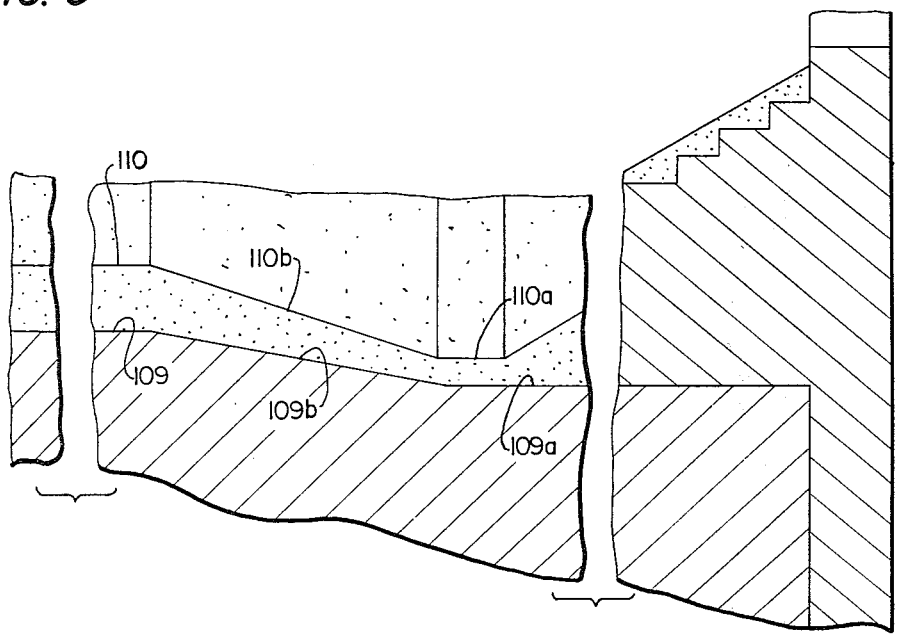

APPARATUS FOR CENTRIFUGAL CASTING

RELATED APPLICATIONS

This application is a continuation of my copending application Ser. No. 887,213, filed Mar. 16, 1978, now abandoned, which was a division of my application Ser. No. 778,705, filed Mar. 17, 1977, now U.S. Pat. No. 4,124,056.

BACKGROUND OF THE INVENTION

It has long been common practice to cast tubular metal articles centrifugally, using a permanent mold which has an active mold surface of circular transverse cross-section, the mold being rotated about the longitudinal axis of the active mold surface. Centrifugal casting molds are made of metal which has a melting point which may not be markedly different from that of the metal being cast, and it is therefore necessary to cover the active mold surface with a lining of a material which will protect the mold from damage by contact with the molten casting metal, prevent the casting from picking up material from the mold surface, and allow the finished casting to be separated from the mold. One method employed by prior art workers for lining centrifugal casting molds has been to apply to the active mold surface a slurry of a finely particulate refractory material, typically zircon powder or silica powder, that method having been used for stationary, non-centrifugal molds as disclosed in U.S. Pat. No. 1,662,354 to Harry M. Williams, and adopted for centrifugal casting, as described in U.S. Pat. No. 3,527,285 to Fred J. Webbere. While they have achieved considerable acceptance, such practices have presented substantial disadvantages, particularly because of the need for venting to dispose of water vapor generated during casting, and because the coatings provided on the mold surface have not always been adequately strong and uniform and have tended to be penetrated by the molten metal being cast, with resulting roughness of the cast surface and increased machining difficulties due to presence of refractory particles in the cast metal. In efforts to avoid such deficiencies, it has been proposed to employ resin binders and other non-inert ingredients as shown for example in U.S. Pat. No. 3,056,692 to Koshiro Kitada, but such coatings are unduly expensive and tend to generate gaseous products at casting temperatures so that the mold must be vented. As disclosed for example in U.S. Pat. No. 3,110,067 to Donald C. Abbott, it has been proposed to spray a resin binder onto the surface of a heated relatively thick pre-formed refractory layer with the intent of eliminating the need for venting the mold but, at best, that practice still requires the use of both a relatively expensive refractory material and a relatively expensive resin.

It has also been proposed to apply only the particulate refractory material, without water or other liquid carrier material and without additive binders such as bentonite or resin, primarily to control the grain structure of the cast metal. As disclosed in U.S. Pat. No. 1,949,433 to Norman F. S. Russell et al, such methods employ a carrier gas to carry the particulate refractory material onto the active mold surface immediately in advance of the casting metal and depend upon centrifugal force to establish a very thin coating layer of the refractory material, said to be limited to not more than 0.025 mm. in thickness. Such methods have been adopted for casting some articles, such as pipes, which do not require a particularly smooth outer surface, but are not suitable for products, such as engine cylinder liners, which require a relatively smooth outer surface free of chilled iron. The as-cast surface is usually quite rough, so that substantial machining would be required for finished castings with a smooth outer surface, and the nature of the thin coating of particulate refractory material has been such that particles of the refractory material are picked up by the cast article and interfere seriously with machining by slowing the machining rate and drastically reducing cutting tool life. Use of a thin coating of refractory material also limits the practice to production of articles which have no outer enlargements unless, as in the case of a pipe with an end bell, the enlargement can be outwardly tapering and located at the very end of the mold. Further, such very thin linings do not provide thermal insulation adequate to delay the solidification of the molten iron, when iron is the metal being cast, sufficiently to cause Type A graphite to be formed, a definite requirement for cast articles such as cylinder liners and bearings.

A further disadvantage of prior art methods arises from the relative cost of the refractory material and the difficulty in recovering that material, after casting, for reuse. Materials such as zircon flour have a per pound cost greater than that of the metal being cast. When additive materials such as clays, bentonite or resins are employed, recycle of the refractory material is impractical. When only a thin layer, such as that disclosed in U.S. Pat. No. 1,949,433, is employed, much of the refractory material is simply lost, by being picked up by the casting and otherwise, so that recovery is at best difficult and costly.

OBJECTS OF THE INVENTION

A general object of the invention is to provide apparatus capable of casting tubular articles in centrifugal molds having a shaped lining of binderless particulate refractory material and recovering the particulate material for re-use.

Another object is to devise such an apparatus capable of recovering a large proportion of the refractory material used for the lining so that relatively costly refractory materials can be employed.

SUMMARY OF THE INVENTION

Apparatus according to the invention are useful for practicing the method described and claimed in my U.S. Pat. No. 4,124,056. According to that method, the metal casting mold is provided with a lining formed of binderless particulate refractory material, the lining being thicker than the thickest portion of the casting and being maintained by centrifugal force. The apparatus comprises a mold supporting and rotating unit, an elongated mold lining device which is inserted axially into the mold preparatory to establishing the lining and then withdrawn from the mold, puller means for withdrawing the cast article from the mold, and a recovery unit, the recovery unit comprising a chamber having coaxial openings, through which the cast article is moved by the puller means, means for dislodging particulate refractory material from the cast article as it is pulled through the chamber, and means for withdrawing the particulate refractory material from the chamber. Advantageously, the refractory material is withdrawn from the chamber by air flow derived in part from the interior of the mold.

In order that the manner in which the foregoing and other objects are achieved according to the invention can be understood in detail, particularly advantageous embodiments thereof will be described with reference to the accompanying drawings, which form part of the original disclosure of this application, and wherein:

FIG. 7 is a fragmentary transverse sectional view of a brush employed in the apparatus of FIG. 6;

FIG. 9 is a view, similar to FIG. 2A, illustrating a refractory lining according to another embodiment of the invention.

APPARATUS EMBODIMENT OF FIGS. 1-8

Figure 2:
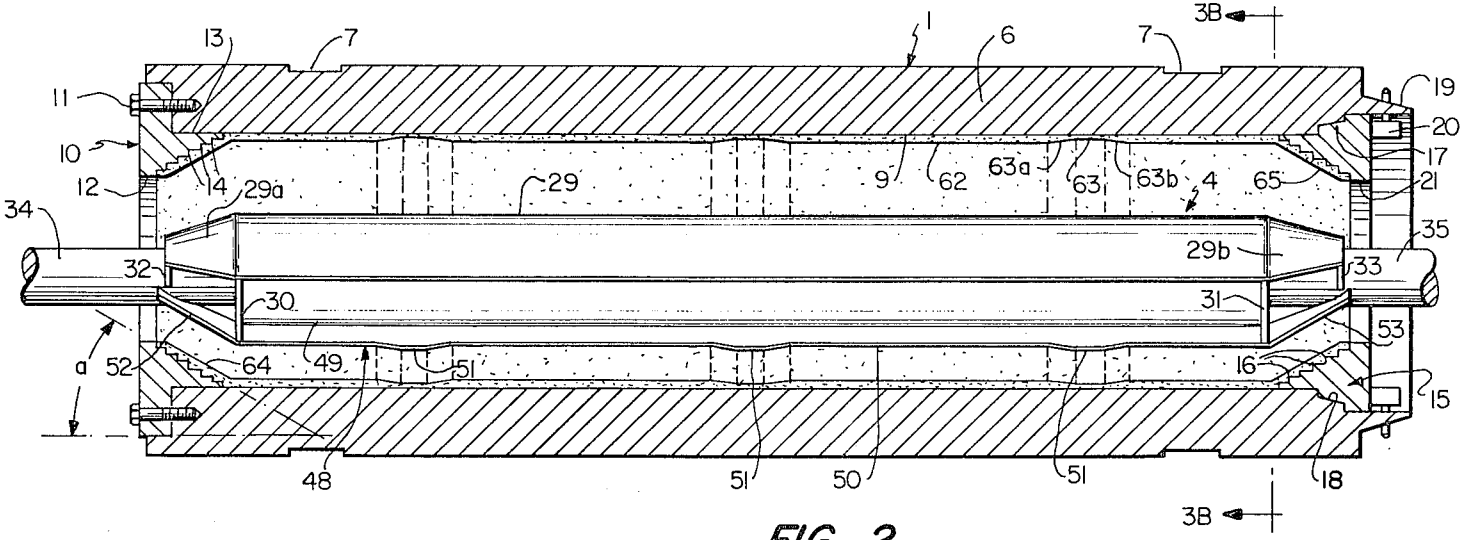
FIG. 2 is a longitudinal vertical sectional view, with some parts shown in side elevation, of an apparatus according to one embodiment of the invention.
Figure 4:
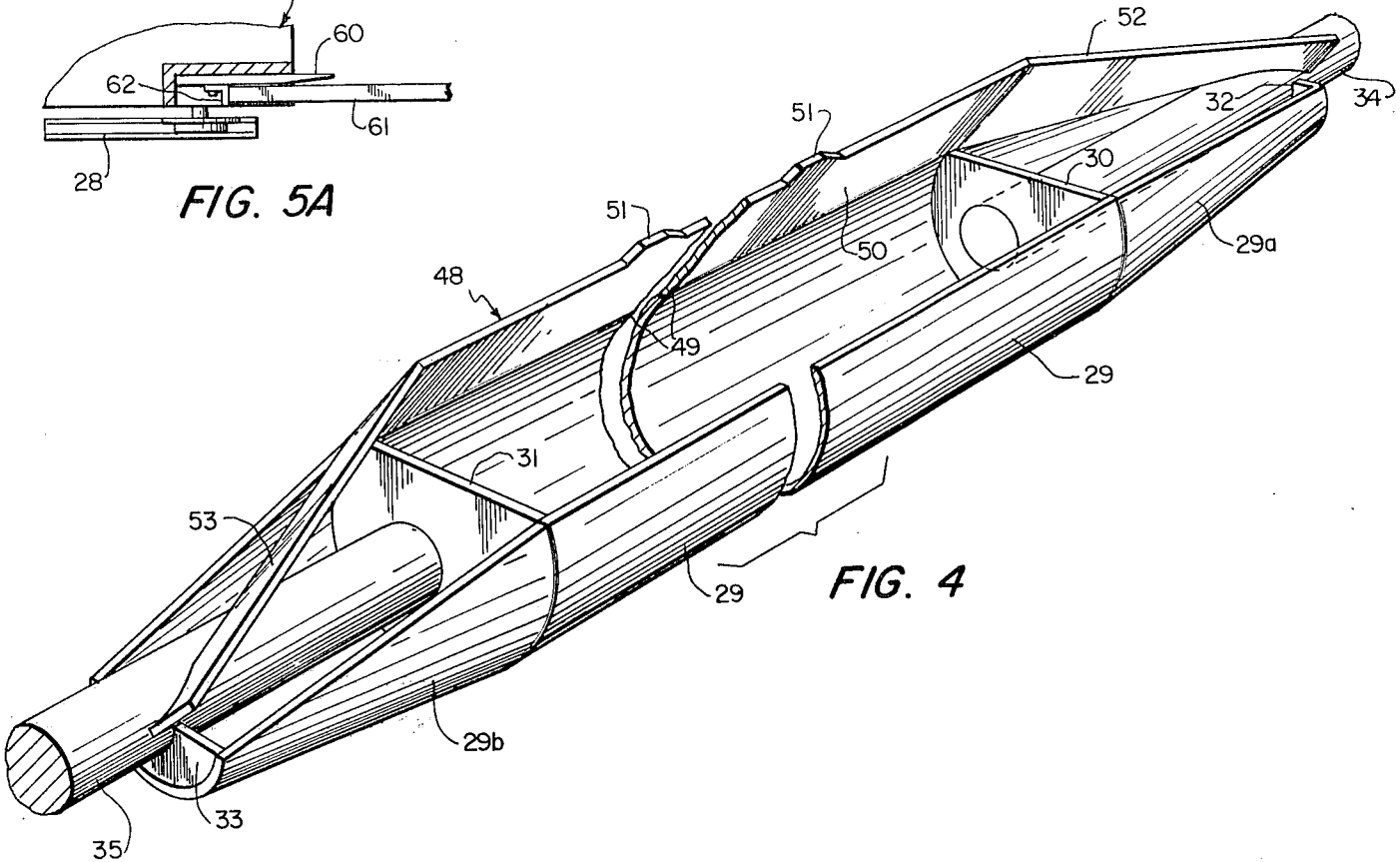
FIG. 4 is a perspective view of a combined trough and contouring tool forming part of the apparatus of FIG. 2.
Figure 5A:
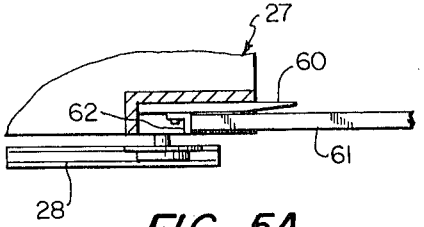
FIG. 5A is a fragmentary top elevational view of a portion of the apparatus shown in FIG. 5.
Figure 5:
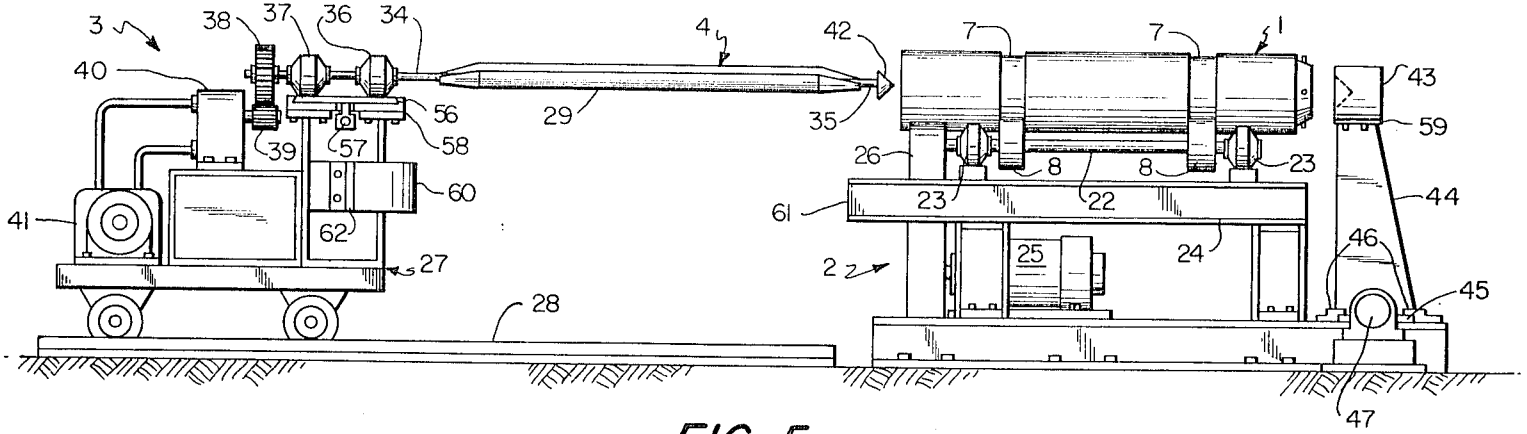
FIG. 5 is a side elevational view of the apparatus of FIGS. 2-4 incorporated in a typical installation.
Figure 6:
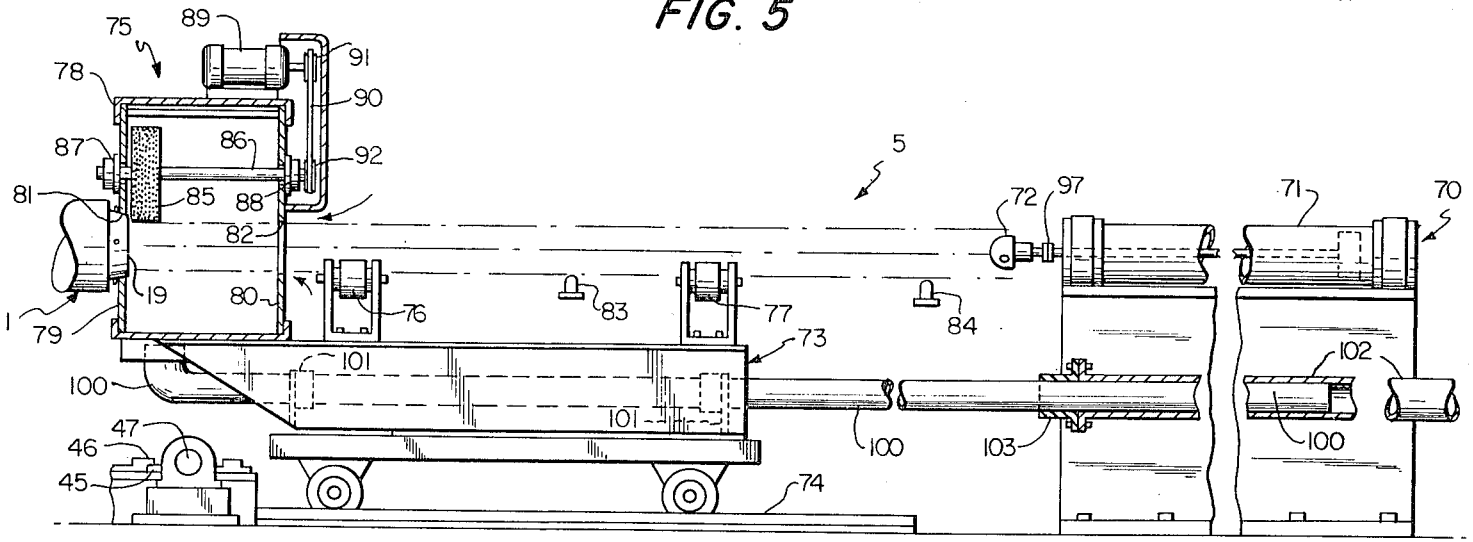
FIG. 6 is a side elevational view of apparatus for withdrawing the article cast in the apparatus of FIGS. 2-5 and recovering the refractory material.

Apparatus for carrying out the method typically comprises a mold, indicated generally at 1, FIGS. 2 and 5; means 2, FIG. 5, for supporting and rotating the mold; means indicated generally at 3, FIG. 5, for supplying the refractory material to the mold, the supply means 3, FIG. 5, including a combined trough and contouring tool 4, FIGS. 2, 4 and 5, which also serves to recover excess refractory material at the time the refractory lining is established; and the combined casting puller and refractory recovery device indicated generally at 5, FIG. 6. Also employed, but not shown, is any suitable conventional means for supplying the molten casting metal to the mold, typically a pouring "boot" which can be brought into position at the end of the mold from which the castings are pulled.

The body of mold 1 is in the form of a thick walled tube 6 having two axially spaced outwardly opening transverse annular grooves 7 to accommodate the usual supporting and driving rollers 8, FIG. 5. Mold body 1 has a right cylindrical inner surface 9 which is the active surface of the mold. At one end, body 1 is recessed to receive a transverse annular end ring 10 which is secured by bolts 11 with its inner periphery 12 concentric with the longitudinal axis of the surface 9. End ring 10 has a tubular extension 13 embraced by surface 9. The inner surface of extension 13 is formed with transverse annular steps the forward edges 14 of which all lie in a conical plane which tapers outwardly of the mold and toward the longitudinal axis of surface 9 at an angle a which is less than the angle of repose of the particulate refractory material to be used for the mold lining. At its opposite end, mold body 1 is equipped with a second end ring 15 which has a stepped inner surface complementary to that of ring 10, the steps of ring 15 presenting transverse circular edges 16 all lying in a conical plane tapering outwardly of the mold and toward the longitudinal axis of surface 9 at the same angle as for ring 10. The outer surface of ring 15 includes an inwardly tapering frusto-conical portion 17 embraced by a matching surface portion 18 on the mold body 1. Body 1 has an axially extending tubular projection 19 having a plurality of radial bores each accommodating one of a plurality of drive keys 20 dimensioned to force end ring 15 into the seated position seen in FIG. 2. The circular inner periphery 21 of ring 15 is concentric with the longitudinal central axis of surface 9.

Four rollers 8 can be employed in spaced pairs to cradle the mold 1 and are secured to shafts 22, FIG. 5, supported by bearings 23 mounted on stationary frame 24, shafts 22 being driven by a DC electric motor 25 through a conventional V-belt drive 26.

Trough and contouring tool 4, which forms part of the refractory supply means 3, is of such size as to occupy a substantial part of the free space within the mold and must therefore be completely withdrawn preparatory to introduction of the molten casting metal. Accordingly, the combined trough and contouring tool 4 is carried by a car 27, FIG. 5, operating on rails 28 so arranged that the car can be moved to the right (as viewed in FIG. 5) for insertion of the device 4 axially into the mold, and then moved in the opposite direction to withdraw device 4 completely once the refractory lining has been established on active surface 9 of the mold and contoured to the desired form.

As best seen in FIG. 4, device 4 comprises an elongated trough 29 of generally U-shaped transverse cross-section. Rigid transverse partitions 30, 31 are secured within the trough and are spaced apart by a distance slightly less than the space between the inner ends of rings 10 and 15, FIG. 2. Commencing at the partitions 30 and 31, the trough is provided with tapered end portions 29*a* and 29*b* respectively, the angle of taper and the transverse dimensions of the end portions being such that the tapered end portions will not interfere with refractory material overlying the end rings 10 and 15. Additional partitions 32, 33 are secured at the respective ends of the trough. Trunnions 34, 35 are provided at the respective ends of the trough, the inner portions of the trunnions passing through openings in the respective partitions 30, 31 and 32, 33 and being rigidly secured, as by welding, to the partitions. Trunnions 34 and 35 are coaxial and so positioned as to establish an axis of rotation for the trough which is off center, as later described. Trunnion 34 is considerably elongated, so as to be accommodated by two trunnion bearings 36 and 37, FIG. 5, and to project beyond bearing 37. A gear 38 is fixed to the projecting end of trunnion 34 and meshes with a drive pinion 39 fixed to the output shaft of a hydraulic motor 40 powered by a pump 41, the entire assembly being suitably mounted on car 27.

A tapered plain rotary bearing member 42, FIG. 4, is rigidly mounted on the end of trunnion 35 to cooperate with a corresponding stationary bearing member 43, FIG. 5, supported by a pedestal 44. Pedestal 44 has a base 45 slidably retained in a horizontal keyway 46 which extends at right angles to the longitudinal axis of the mold so that, by movement of the pedestal along the keyway, the stationary bearing member 43 can be moved between the active position seen in FIG. 5, in which bearing members 42 and 43 are coaxial, and an inactive position in which pedestal 44 is displaced laterally from the mold to allow free pulling of the casting and to allow the pouring boot (not shown) to be moved to its pouring position. A fluid pressure operated rectilinear power device 47 is provided to move the pedestal between the active and inactive positions.

Device 4 is completed by an elongated contouring blade 48 rigidly secured to and extending along one longitudinal edge 49 of the wall of trough 29. The main body 50 of blade 48 extends throughout the full space between partitions 30 and 31. In the case where the centrifugal casting operation is to produce a tubular blank made up of six cylinder liner blanks of the configuration seen in FIG. 1 joined flange-end-to-flange-end, the active edge of contouring blade 48 is formed with three identical projections 51 each having a profile, as best seen in FIG. 2, identical to that presented by two of the enlargements F joined end-to-end. The remainder of the active edge of the main body of blade 48 is a simple straight edge and is parallel to the axis of rotation defined by trunnions 34 and 35 and their respective bearings. Beyond partition 30, blade 48 continues as a straight-edged blade portion 52 secured at one end to the adjacent end of body 50 and at the other end to trunnion 34. Beyond partition 31, blade 48 similarly continues as a straight edged blade portion 53.

Figure 3:
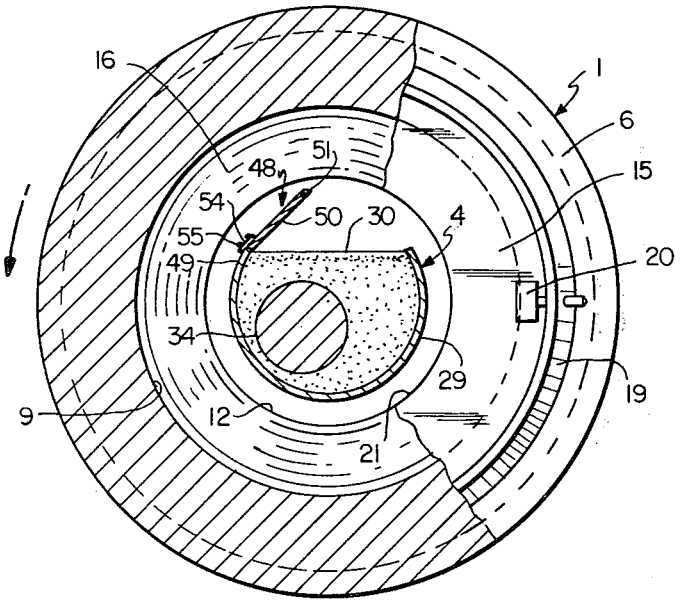
FIGS. 3-3B are transverse sectional views, with some parts shown in end elevation, views of the apparatus, taken generally on line 3—3, FIG. 2, showing the combined supply trough and contouring tool in different rotational positions, FIG. 3B illustrating the position seen in FIG. 2.

As seen in FIG. 3, the transverse cross-section of trough 29 can be generally circular, with the mouth of the trough defined by a plane which is chordal relative to the circular cross-section. Main body 50 of the contouring blade can then be flat and extend in a plane which is essentially tangential to the circular cross-section with the point of tangency being substantially at one edge of the mouth of the trough. The body 50 can be secured to the trough in any suitable fashion, as by an external bridging strip 54 and screws 55. Considering that the trough is shown in its upright position in FIG. 3 with the circular cross-section concentric with the longitudinal central axis of mold surface 9, which is the axis of rotation of the mold, it will be noted that the common axis for trunnions 34, 35 is offset along a line slanting at 45° downwardly and to the left (as viewed) from the axis of rotation of the mold. The trough is thus eccentric with reference to the cylindrical active mold surface, but the extent of eccentricity is such that the outer edge of contouring blade 48 will clear surface 9 when the device 4 is rotated counterclockwise from the position seen in FIG. 3 to the position seen in FIG. 3A.

Figure 3A:
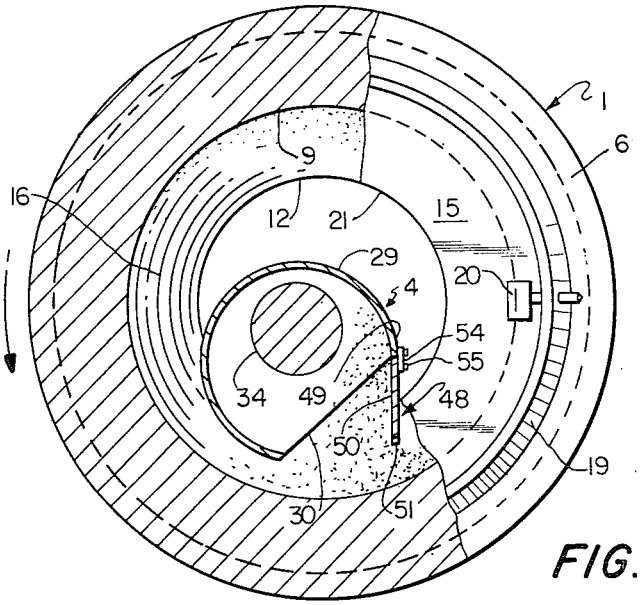
Figure 3B:
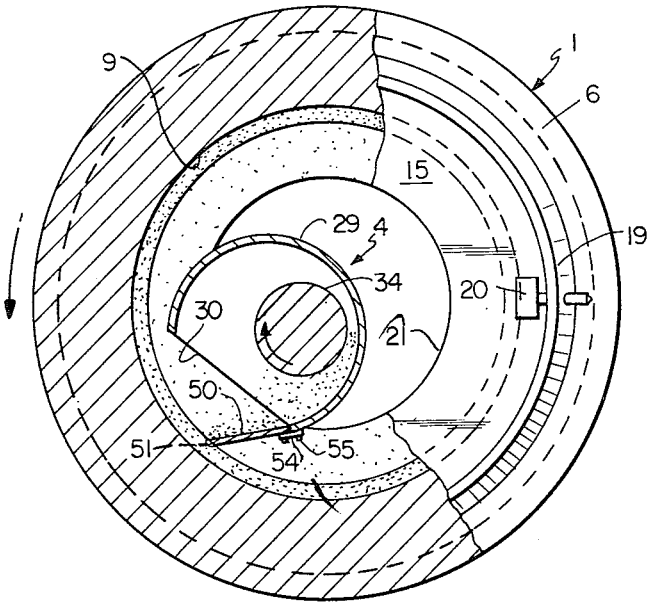

Since device 4 is eccentric with respect to mold surface 9, there is a given rotational position for device 4 in which the edge of contouring blade 48 is at its point of closest proximity to the mold surface, that position being illustrated in FIG. 3B. The proximity of the contouring blade will determine the thickness of the finished refractory lining and is thus dependent upon the outer diameter desired for the casting. In order that the position of the contouring blade relative to the mold can be predetermined accurately, the transverse horizontal position of car 27 is fixed, the bearings 36 and 37 are mounted on a keyway 56, FIG. 5, for transverse horizontal adjustment by srew 57, with the vertical position of bearings 36 and 37 being adjustable by shimming at 58, and conventional means (not shown) is provided for vernier adjustment of pedestal 44 along its keyway 46 to horizontally adjust the position of bearing member 43. Vertical adjustment of bearing member 43 is accomplished by shimming at 59. Because of wheel play and like variables, rails 28 do not locate car 27 in a precise transverse horizontal position. Accordingly, to achieve a precise horizontal base position for car 27, and thus for trunnion 34, the car is provided with two forwardly projecting locator bars 60, FIGS. 5 and 5A, each located at a different side of the car and each having an outer face which slants forwardly and toward the longitudinal center line of the car. The stationary frame of mold supporting and rotating unit 2 is provided with two locator beams 61 which project toward the location of car 27 on rails 28 and are spaced apart by a distance such that, as the car approaches unit 2, the outer face of each locator bar 60 on the car is engaged by the end of a different one of the two locator beams 61 and the car is therefore constrained to a position centered between beams 61. Unit 2 is so constructed and arranged that the axis of rotation of mold 1 is centered between beams 61. Each locator bar 60 is equipped with an outwardly projecting stop flange 62 disposed to engage the end of the corresponding locator beam 61 when forward motion of car 27 brings bearing member 42 into seated relation with respect to bearing member 43. Movement of car 27 can be accomplished by a rectilinear hydraulic power device in well-known fashion.

The particulate refractory material is charged to trough 29, uniformly throughout the length of the trough, when car 27 is in a position, as in FIG. 5, such that trough 29 is entirely removed from mold 1. With trough 29 maintained in its upright position, car 27 is then moved to insert device 4 through mold 1, such movement being continued until bearing member 42 is seated in bearing member 43 and locator beams 61 are engaged by stop flanges 62. By operation of motor 40, device 4 is rotated counterclockwise until the position seen in FIG. 3A is reached, with the result that the total quantity of particulate refractory material in the trough is discharged into the mold. According to the method, that quantity of refractory material is substantially in excess, typically 150%, of that required to form the desired lining. Though the initial layer of particulate refractory material can be established with the mold rotating at any practical rate when the particulate material is discharged from the trough, best distribution and lowest cycle times are achieved if the mold is stationary or rotating at a rate providing a centrifugal force not more than 15 gravities at the time the trough is rotated to discharge the material. Using refractory materials, such as zircon flour, which have a relatively high specific gravity, the rate of mold rotation used to distribute the material centrifugally may be adequate to densify the layer of refractory material preparatory to contouring. When the total quantity of particulate material has been distributed in an even relatively thick layer as a result of rotation of the mold, and densification has been accomplished, device 4 is rotated clockwise until, as seen in FIG. 3B, the edge of blade 48 is at its point of nearest proximity to surface 9. With device 4 in that position, the outer edge of contouring blade 48 engages the layer of particulate refractory material on surface 9 at an angle such that the refractory material approaches the side of blade 48 which faces the open mouth of trough 29. Accordingly, the blade deflects all of the excess refractory material back into trough 29, where it is retained by the combination of the trough and the contouring blade, and the ultimate effect is that blade 48 planes the layer of refractory material to the precise thickness and profile (limited only by the angle of repose of the particulate refractory material) desired for the final lining. Thus, the main straight edge portion of blade 48 establishes right cylindrical surfaces on the layer, indicated at 62, FIG. 2A, while portions 51 of the blade established the surfaces 63, 63*a* and 63*b* to define the groove for casting of the end flange portions F of the cylinder liner blank seen in FIG. 1. In actual practice, device 4 is rotated clockwise from the position seen in FIG. 3A continuously at a slow rate, in comparison to the rate of rotation of the mold, to the position shown in FIG. 3, so that the contouring blade simply passes through the position seen in FIG. 3B. The excess refractory material returned to the trough 29 by the action of blade 48 simply remains in trough 29, when device 4 is withdrawn from the mold, and constitutes part of the refractory material to be used for the next casting.

When the initial charge of particulate refractory material is delivered to trough 29, the end portions 29*a* and 29*b* of the trough receive quantities of refractory material adequate to cover the stepped surfaces presented respectively by end rings 10 and 15. Because the exposed edges 14 and 16 of the steps of rings 10 and 15, respectively, constitute in effect a tapered surface at an angle less than the angle of repose of the refractory material, the material discharged by the end portions of the trough remains in position on the stepped surfaces of the end rings and this material is shaped to provide the smooth frusto-conical surface portions 64 and 65 of the finished lining, as seen in FIG. 2. The excess refractory material from these areas is returned to the respective end portions of the trough by portions 52 and 53 of the contouring blade as device 4 passes through the position seen in FIG. 3B during return of device 4 to its initial position.

It will be noted that provision of the stepped surfaces of end rings 10 and 15, and provision of end portions 52 and 53 of the contouring blade, eliminates the need for inserting the usual pre-formed sand cores to retain the molten casting metal. The refractory lining produced according to the invention is a completely monolithic lining from end ring to end ring, presents no seams or lining joints, is of precisely desired radial thickness, and has precisely the profile presented by the contouring blade.

With a mold dimensioned for the cylinder liner blank hereinbefore described with reference to FIG. 1, the rate of rotation of the mold can be increased to 500 r.p.m. for hardening the refractory lining and then further increased to, e.g., 900 r.p.m. preparatory to introduction of the molten casting metal.

Device 4 having been removed, motor 47 is now operated to move pedestal 44 and bearing 43 away from the end of the mold, and the pouring boot (not shown) is swung into place and the molten casting metal poured through end ring 15 in conventional fashion. The pour is accomplished conventionally, with the mold being rotated at a casting rate, e.g., 800–900 r.p.m., to distribute the molten metal centrifugally. At this stage, lining surfaces 64 and 65, FIG. 2, serve as end dams to prevent escape of the metal from the mold. The casting is cooled conventionally. For cooling, a water spray can be directed against the outer surface of mold by the usual spray means (not shown).

The pouring boot is removed and, with pedestal 44 remaining in its displaced position, unit 5, FIG. 6, is employed to withdraw the casting from the mold and to recover the refractory material of the lining. Unit 5 includes a conventional puller 70 mounted in fixed position with its fluid pressure operated motor 71 aligned coaxially with the mold so that, when the piston rod of the motor is fully projected, puller head 72 is located within one end of the casting, the position of the puller 70 thus being spaced from the mold by a distance somewhat less than the maximum excursion of head 72. Operation of the puller is conventional, and it will be understood that end ring 15 is removed prior to pulling of the casting from the mold.

A car 73 is located between puller 70 and unit 2 and is supported by rails 74 for movement parallel to the longitudinal axis of the mold supported by unit 2. Car 73 carries a refractory collecting unit 75 and two pairs of casting support rollers 76 and 77. Unit 75 comprises a housing 78 having flat end walls 79 and 80, the housing being rigidly mounted on car 73. End walls 79 and 80 are vertical, extend transversely of the central axis of the mold supported by unit 2, and are spaced apart in the direction of that axis. Nearer the mold, wall 79 has a circular opening 81 sized and positioned to slidably embrace the tubular end extension 19 of the mold body. Disposed nearer the puller, end wall 80 has a circular opening 82 which is coaxial with opening 81 and of a diameter significantly larger than the largest outer diameter to be pulled. End walls 79 and 80 are spaced apart by a distance smaller than the length of the casting. Support rollers 76, 77 are located on the side of housing 78 which is nearer puller 70. Rails 83 and 84 are mounted to extend transversely relative to the axis of the mold supported on unit 2 and include cantilevered end portions which project below the path travelled by the casting as it is pulled, rail 83 being between rollers 76 and 77 while rail 84 is between car 73 and puller 70. Rails 83 and 84 are spaced apart by a distance shorter than the length of the casting but longer than the total excursion of support roller pair 77 as car 73 is moved between its active position FIG. 6, and an inactive position (not shown), chosen to make room for the pouring boot and for bearing pedestal 44. When car 73 is in its active position, with wall 79 of housing 78 engaged with the mold, operation of the puller to extend its piston rod causes puller head 72 to pass through openings 80 and 79 and into the adjacent end of the mold for engagement with the casting. When the puller is operated to retract its piston rod, the casting is drawn first through opening 81, then through the interior of housing 78, then through opening 82, thence onto supporting rollers 76 and 77 and, when pulling ceases, onto rails 83, 84.

Figure 1:
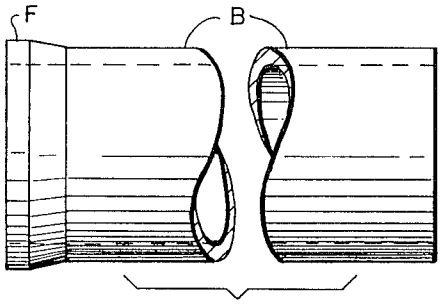
FIG. 1 is a side elevational view of a cast article typical of articles produced with apparatus according to the invention.
Figure 2A:
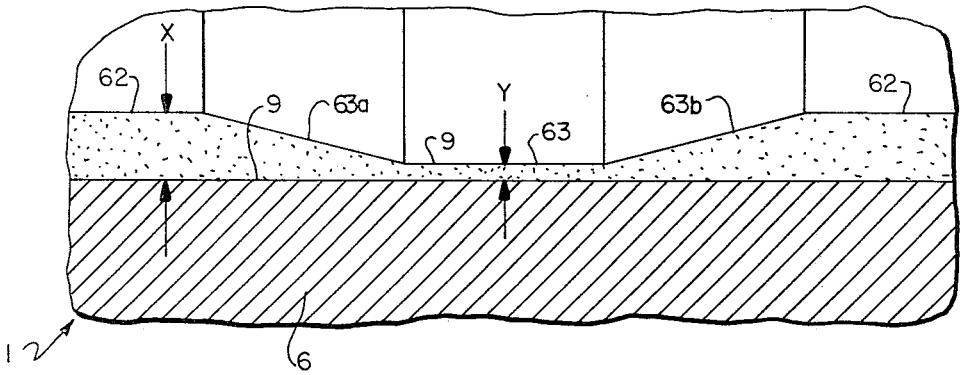
FIG. 2A is a fragmentary sectional view, greatly enlarged as compared to FIG. 2, illustrating a portion of a refractory lining according to the invention.

It is to be noted that, if six cylinder liner blanks such as that shown in FIG. 1 are made in a single casting, with the liner blanks joined flanged end to flanged end, the casting is in the nature of a single pipe-like piece which is of uniform outer diameter save for the three transverse annular enlargement formed by the three grooves in the refractory lining of the mold, the six liner blanks ultimately being separated by cutting the casting at the midpoint of each enlargement and at the midpoint of each body section.

Save for openings 81 and 82, housing 78 is air-tight. The housing projects well above the location of the mold. A rotary brush 85 is supported within housing 78, above the path of travel of castings pulled through the housing, by a shaft 86 journelled in bearings 87, 88 secured respectively to end walls 79 and 80. A drive motor 89 is mounted on the top wall of housing 78 and drives shaft 86 and brush 85, as by V-belt 90 and pulleys 91, 92. As seen in FIG. 7, brush 85 is of the centrifugal bristle type and comprises a hub 93, secured to shaft 86, and two side discs 94 between which a circumferentially spaced series of bristle support pins 95 extend, the support pins being secured to the side discs. Each pin 95 supports a plurality of bristles 96 formed of heavy, stiff but resilient wire, one end 97 of each bristle being bent circularly to loosely embrace its respective support pin. When shaft 86 is rotated, bristles 96 are caused to extend radially from the brush by centrifugal force. The location of shaft 86 and the effective diameter of brush 85 are such that, with motor 89 operated to rotate the brush as the casting is withdrawn, the bristles of the brush impinge upon the outer surface of the casting and dislodge any refractory material which has not already fallen from the casting. Puller head 72 is mounted on the piston rod or puller 70 by means of a rotary connector 97, FIG. 6, so that the puller head is free to rotate about the axis of the piston rod. Pulling of the casting is accomplished while the mold is still being rotated, through at a very slow rate, by support and drive rollers 8. Accordingly, the casting is rotating slowly about its longitudinal axis as it is pulled through housing 78 and past brush 85, and the bristles 96 of the brush thus strike all portions of the outer surface of the casting.

Since the particulate refractory lining material contains no binder material and is itself virtually unaffected at casting temperatures, all of the refractory material is dislodged from the casting by the pulling and brushing operation.

Figure 8:
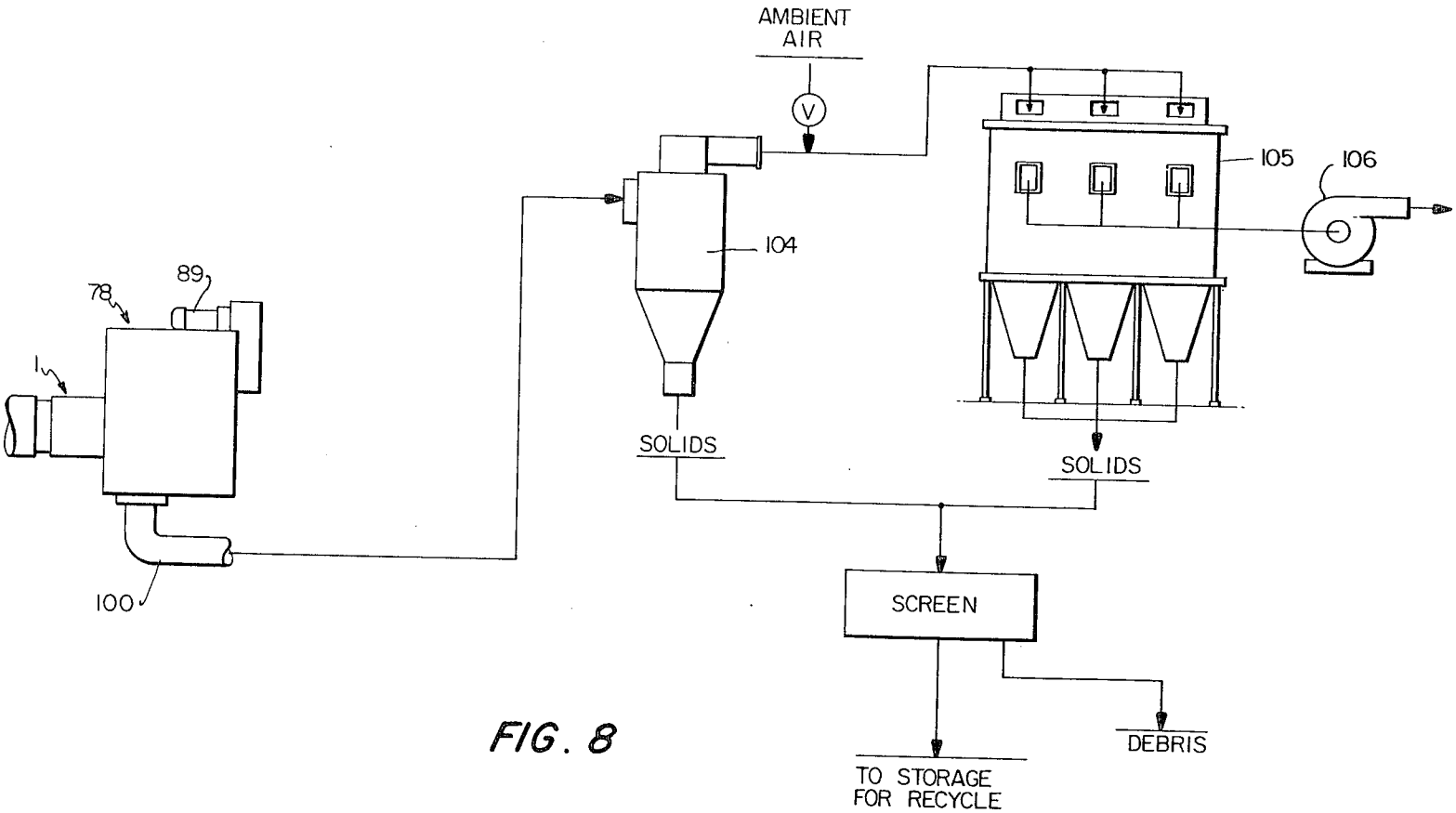
FIG. 8 is a schematic diagram of a system for recycling the recovered refractory material.

An exhaust duct 100 is connected to an opening in the bottom wall of housing 78 and extends horizontally lengthwise of car 73, being mounted rigidly on the bed of the car, as by brackets 101. A straight portion of duct 100 projects horizontally beyond car 73 and is telescopically engaged within a stationary horizontal duct 102 rigidly secured to the base of the puller unit. A tubular slip seal 103 is provided at the end of duct 102 to seal between stationary duct 102 and movable duct 100. Duct 102 leads to the intake of a centrifugal separator 104, FIG. 8. Air flowing from separator 104 is delivered to the intakes of a conventional bag filter 105, the fluid outlets of which are connected to the intake of a centrifugal blower 106. Solids separated by centrifugal separator 104 and bag filter 105 are combined and supplies to a screen sized to remove debris, such as metal fragments, and the clean recovered refractory material is delivered to storage for recycle.

The air intake for housing 78 is constrained to the interior of the mold and the small space between the wall of opening 82 and the casting. With blower 106 operating to provide a high volume flow rate, air flow through the mold into chamber 78 is adequate to pick up and convey to chamber 78 the greater proportion, e.g., 90% of all refractory material remaining in the mold after pulling of the casting. In this connection, it is to be noted that, as the casting is pulled, the transverse outer enlargements formed by lining grooves 63 tend to scrub the refractory material toward housing 78, and this action also tends to break up any agglomerates or clusters of particles returning the residual refractory material to its free flowing particulate state. Further, since blower 106 can draw air only from the mold and opening 82, the air inflow to housing 78 is generally along the surface of the casting being pulled, and the air flow into the housing therefore tends to scrub the outer surface of the casting.

EMBODIMENT OF FIG. 9

In the method and apparatus embodiments described above, the active surface of the mold is right cylindrical, and the outer enlargement for the casting is accommodated by the thickness of the refractory lining. In some cases, however, it is desirable to contour the active surface of the metal mold, particularly in the case of relatively large castings which should be cast one at a time. Thus, as seen in FIG. 9, the active surface 109 of the mold can be machined to provide a surface portion **109*a* of increased diameter in the area to be occupied by the outer enlargement of the casting, the smaller diameter right cylindrical main portion 109 and portion 109*a* being interconnected by a frusto-conical portion 109*b*. The layer of particulate refractory material to form the refractory lining is then established as described with reference to FIGS. 2–8, with the layer being shaped by a contouring tool so dimensioned and shaped that the portion 110*a* of the lining overlying mold surface portion 109*a* is markedly thinner than the main body of the lining. The lining portion 110*b* overlying mold surface portion 109*b* tapers in thickness uniformly from that of main body 110 to thin portion 110*a*. Main body portion 110** of the lining is right cylindrical. Higher heat transfer through the thin portion of the lining is thus preserved, even though the mold has been machined to partially accommodate the outer enlargement of the casting, and the metal in this area will not chill too rapidly or cool too slowly.

What is claimed is:

1. In an apparatus for producing tubular metal articles by centrifugal casting, the combination of mold supporting and rotating means for supporting and rotating a mold about a horizontal axis;

a generally tubular open ended centrifugal casting mold mounted on said mold supporting and rotating means and having an active mold surface which is of circular cross section transverse to the horizontal axis of mold rotation;

means associated with said mold for establishing on the active surface of said mold, while the mold is supported and rotated by the supporting and rotating means, a lining consisting essentially of finely particulate binderless refractory material, the lining having a profile identical to that desired for the article to be cast;

puller means associated with an end of said mold supporting and rotating means and movable between an inactive position, spaced from the supporting and rotating means, and an active position in which the puller means is moved into said mold to engage a cast article in the mold, the puller means being driven by power means for moving said puller means to its active position to engage the cast article and thereafter moving said puller means to its inactive position to withdraw the cast article; and recovery means for recovering the binderless refractory material as the cast article is pulled from said mold by the puller means, the recovery means comprising means defining a chamber having spaced end walls each provided with an opening, said openings being coaxially aligned and dimensioned to accommodate an article cast in said mold, means for supporting the chamber for movement between an inactive position, in which the chamber is displaced from the supporting and rotating means, and an active position, in which the chamber is disposed between the supporting and rotating means and the puller means and one of the chamber openings is registered with an adjacent end of said mold and both of the chamber openings are coaxial with the mold, said puller means being movable through said chamber via said openings to pull the cast article through the chamber when the chamber is in its active position, means within said chamber for dislodging particulate material from the cast article as the cast article is moved through the chamber by the puller means, and means associated with said chamber for withdrawing from the chamber the refractory material received by the chamber when the cast article is pulled therethrough by the puller means.

2. The combination defined in claim 1, wherein one of the chamber openings embraces the adjacent end of the mold when the chamber is in its active position.

3. In an apparatus for producing tubular metal articles by centrifugal casting, the combination of mold supporting and rotating means for supporting and rotating a mold about a horizontal axis;

a generally tubular open ended centrifugal casting mold mounted on said mold supporting and rotating means and having an active mold surface which is of circular cross section transverse to the horizontal axis of mold rotation;

first movable support means associated with one end of said mold supporting and rotating means;

an elongated mold lining device carried by said first movable support means and dimensioned to be inserted horizontally into and withdrawn horizontally from said mold supported by the supporting and rotating means, the mold lining device comprising elongated trough means dimensioned to contain a quantity of free-flowing binderless particulate refractory material in excess of that required to line said mold supported by the supporting and rotating means and operative to discharge the quantity of refractory material into the mold for centrifugal distribution into a layer covering the active surface of the mold, an elongated rigid contouring blade extending lengthwise of the mold lining device and movable between an inactive position and an active position, the contouring blade having a profile identical to that desired for the article to be cast and being so dimensioned and positioned that, when the trough means and blade are in predetermined positions relative to the mold and the quantity of particulate material has been discharged from the trough means and centrifugally distributed into a layer on the active surface of the mold, the active edge of the blade will contour the layer to the shape and dimensions required for casting the desired article and will return the excess particulate material into the trough means, said profile being such that the active edge of the blade includes at least one portion which is relatively nearer the active surface of said mold and at least another portion which is relatively more distant from the active surface of said mold supported by said supporting and rotating means when the blade is in its active position within said mold, the first movable support means being constructed and arranged for insertion of the mold lining device into said mold supported by the supporting and rotating means, preparatory to lining the mold, and withdrawal of the mold lining device from said mold after the lining has been established and contoured;

puller means associated with an end of said mold supporting and rotating means and movable between an inactive position, spaced from the supporting and rotating means, and an active position in which the puller means is moved into said mold to engage a cast article in said mold supported by the supporting and rotating means, the puller means being driven by power means for moving said puller means to said active position to engage a cast article and thereafter moving said puller means to said inactive position to withdraw the cast article; and recovery means for recovering particulate refractory material as the cast article is pulled from said mold by the puller means, the recovery means comprising means defining a chamber having coaxially aligned openings dimensioned to accommodate the cast article, means supporting the chamber for relative movement between the chamber and the supporting and rotating means whereby the chamber can occupy an active position between the puller means and said mold when the puller means is in its inactive position and the mold is supported by the supporting and rotating means in which active position of the chamber one of the chamber openings is registered with an adjacent end of said mold and both of the chamber openings are coaxial with the mold, said puller means being movable through said chamber via said openings to pull the cast article through the chamber when the chamber is in its active position, means within said chamber for dislodging particulate material from the cast article as the cast article is moved through the chamber by the puller means; and means associated with said chamber for withdrawing from the chamber the particulate refractory material received by the chamber when the cast article is pulled therethrough by the puller means.

4. The combination defined in claim 3, wherein the means for withdrawing particulate refractory material from the chamber comprises a flow duct communicating with the interior of the chamber, and a blower communicating with the duct and operative to establish air flow through the chamber and the flow duct at a high volume flow rate to carry the particulate refractory material from the chamber through the flow duct.

5. The combination defined in claim 4, wherein said means defining the chamber includes a plurality of walls, one of said walls defining the one of the coaxially aligned chamber openings which is registered with the adjacent end of said mold, said one opening surrounding the adjacent end of said mold when the chamber is in its active position, another of said walls defining the other of the coaxially aligned chamber openings and said other opening surrounding the cast article being pulled through the chamber; and a portion of the air flow into the chamber is drawn from the interior of the mold from which the cast article is pulled.

6. The combination defined in claim 4 and further comprising a centrifugal separator having its intake communicating with the flow duct and its fluid outlet communicating with the intake of the blower.

7. The combination defined in claim 3, wherein the active edge of the contouring blade has at least one projection to form a groove in the refractory lining during contouring of the lining and the article to be cast therefore has a transverse annular outwardly projecting enlargement corresponding to each such enlargement; and pulling of the cast article causes each transverse enlargement of the cast article to move particulate refractory material of the lining toward the chamber of the recovery unit.

8. The combination defined in claim 3, wherein one of the coaxially aligned openings of the chamber is dimensioned to closely embrace an end portion of said mold supported by the supporting and rotating means when the chamber occupies its active position; and the coaxially aligned chamber openings are spaced apart by a distance less than the length of the cast article.

9. The combination defined in claim 3, wherein the puller means is constructed and arranged to allow rotation of the cast article as the cast article is pulled from the mold.

* * * * *